United States Patent [19]

Hatz et al.

[11] Patent Number: 4,897,024

[45] Date of Patent: Jan. 30, 1990

[54] FUEL INJECTION PUMP FOR INTERNAL COMBUSTION ENGINES

[75] Inventors: Ernst Hatz; Hans A. Kochanowski, both of Ruhstorf; Erich Absenger, Passau, all of Fed. Rep. of Germany

[73] Assignee: Motorenfabrik Hatz GmbH & Co. KG, Ruhstorf, Fed. Rep. of Germany

[21] Appl. No.: 192,301

[22] Filed: May 10, 1988

[30] Foreign Application Priority Data

Sep. 22, 1987 [DE] Fed. Rep. of Germany ..... 3731817

[51] Int. Cl.[4] ..... F02M 45/06

[52] U.S. Cl. ..... 417/499; 417/494

[58] Field of Search ..... 417/499, 494; 123/501, 123/503, 448, 299, 300

[56] References Cited

U.S. PATENT DOCUMENTS

| | | | |
|---|---|---|---|
| 2,871,796 | 2/1959 | Dreisin et al. . | |
| 3,438,359 | 4/1969 | Thoma | 123/300 |

FOREIGN PATENT DOCUMENTS

| | | | |
|---|---|---|---|
| 177968 | 3/1954 | Austria . | |
| 572711 | 3/1933 | Fed. Rep. of Germany . | |
| 948209 | 8/1956 | Fed. Rep. of Germany . | |
| 360980 | 7/1938 | Italy | 123/300 |
| 465887 | 9/1951 | Italy | 123/300 |
| 893621 | 4/1962 | United Kingdom . | |

*Primary Examiner*—Leonard E. Smith

*Attorney, Agent, or Firm*—Flynn, Thiel, Boutell & Tanis

[57] ABSTRACT

A fuel injection pump for self-ignition internal combustion engines, comprising at least one pump piston which is movably arranged in a piston sleeve and, during its stroke, in one direction draws fuel from the suction side into the working chamber of the pump and in the other direction of travel first cuts off the connection to the suction side and then commences delivery, which is divided into pre-injection and main injection, from the working chamber to the injection nozzle.

20 Claims, 2 Drawing Sheets

FUEL INJECTION PUMP FOR INTERNAL COMBUSTION ENGINES

CROSS REFERENCE TO RELATED APPLICATIONS

This application discloses subject matter that is related to subject matter disclosed in U.S. Ser. Nos. 314,138 and 314,139, both filed Feb. 22, 1989.

FIELD OF THE INVENTION

The invention relates to a fuel injection pump and, more particularly, to a pump having structure for abruptly interrupting the flow of fuel to the engine for a brief interval and resuming fuel flow thereafter.

BACKGROUND OF THE INVENTION

Pre-injection of the fuel is known in internal combustion engines and serves to reduce combustion noise. Pre-injection has hitherto been achieved by the application of various means, e.g. fitting additional control spool valves in the injection pipe as flow dividers, or using additional injection pumps and nozzles for pre-injection only. However, the means known hitherto still do not resolve the problem satisfactorily because these means need a considerable amount of space on the engine, increase the prime cost and/or do not ensure a clear division between pre-injection and the main injection phase. Moreover they do not always permit the whole range of loads and speeds to be regulated as desired. It is an object of the present invention to avoid these drawbacks in the known types of construction and at the same time to shape the pump elements used for the main injection phase so as to enable them to also be used for pre-injection, ensuring the desired division between pre-injection and main injection and extensive governing over the entire range of engine loads and speeds.

SUMMARY OF THE INVENTION

In accordance with the invention, the piston has a peripheral groove defined in the axial direction by two outer edges and communicating with the working chamber via a connection bore provided in the piston, and, on the inner periphery of the piston sleeve an internal groove is provided which is defined in the axial direction by two inner edges and can communicate with the suction side via an axial overflow groove provided on the piston, the top outer edge, which faces the working chamber, of the peripheral groove of the piston, and the bottom inner edge, which is remote from the working chamber, of the internal groove of the piston sleeve, running parallel to one another such that, on completion of the suction phase, the piston commences pre-injection of the fuel and after a preset stroke path the top outer edge of the peripheral groove of the piston then slides past the bottom inner edge of the internal groove of the piston sleeve along its entire length and thereby opens a fuel overflow path from the working chamber to the suction side via the peripheral groove of the piston, the internal groove of the piston sleeve and the overflow groove of the piston, thereby abruptly ending pre-injection, and after a further stroke path the main injection phase commences after the overflow through the overflow groove of the piston has been cut off.

Because the positions of the inner and outer edges are geometrically determined to suit each application individually, it is possible to determine both the quantities of pre-injected and main-injection fuel and also the timings for both injection phases and to set a clear interval between them upon assembly of the pump.

The timings of the pre-injection and main injection phases are not, however, bound to a predetermined, inflexible plan. Instead, the invention can also be realized in various embodiments allowing the timings to be freely regulated during operation.

One embodiment is possible in which the top outer edge of the peripheral groove of the piston and the bottom inner edge of the internal groove of the piston sleeve, which coacts therewith, are arranged inclined to the piston axis at the same angle of slope in the manner of a helix. During the angular displacement of the piston required for quantity regulation, these edges will then assume different relative positions to one another and so the end of the pre-injection phase will be regulated in a load-controlled manner, i.e. in response to the respective main injection quantity set, during operation.

One advantageous embodiment is also possible in which the outside end face of the piston that delimits the working chamber runs at least in part inclined to its axis. This means that, when the piston is turned, the outside end face and the suction port can be moved into different relative positions to one another, enabling the start of the pre-injection phase to be adjusted. At the same time this achieves load-controlled regulation of the preinjected quantity.

One still further embodiment of the invention should be mentioned in which in the piston sleeve at least one suction port leading to the working chamber is provided, the limiting edge of the suction port that is at the top in the direction of the stroke running parallel to the outside end face of the piston. This means that, in the delivery stroke, the outside end face of the piston suddenly closes the suction port, thereby abruptly starting the preinjection phase independently of the speed of the engine.

Lastly, in cases where load-controlled regulation of the start of the main injection phase is desired, an embodiment is advantageous in which the end of the axial overflow groove adjoining the peripheral groove of the piston is constituted by an end face inclined at the piston axis, and the top inner edge of the internal groove of the piston sleeve, which inner edge co-acts with said end face, is inclined at the same angle in the manner of a helix.

The grooves on the piston and on the piston sleeve may either extend over the whole periphery of these elements or else take up only part of the periphery. In the first case the manufacturing process is straight forward, while in the latter case it would, for example, be possible to lead a leakage oil return groove to the suction side over the free peripheral area produced between the ends of the peripheral groove.

In all the embodiments of the invention the clear division between the pre-injection and main injection phases over the entire range of engine loads and speeds ensures that there is a clearly defined pause between the injections. During this pause, combustion of the preinjected fuel intensely heats the air charge in the engine cylinder, so that the subsequent combustion of the main injection fuel quantity already begins at an elevated temperature and hence the ignition lag (the interval between the start of injection and fuel-self ignition) is extremely small. Thus, during the combustion process a uniform, slow pressure increase in the cylinder is achieved, and with it a substantial reduction in combustion noise.

BRIEF DESCRIPTION OF THE DRAWINGS

The invention is further described, by way of example, with reference to the accompanying drawings in which.

DETAILED DESCRIPTION

Figure 1:
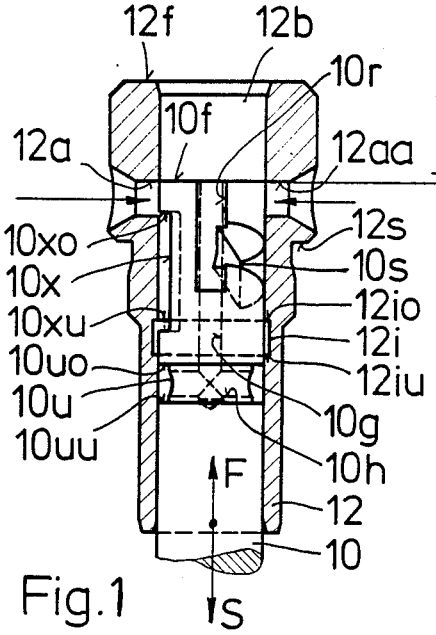
FIGS. 1 to 4 are longitudinal sections of a fuel injection pump according to the present invention, with the pump elements in various operating positions.

In fuel injection pumps for diesel engines, it is known to effect delivery of the fuel by pump pistons, each of which is displaceably arranged in a piston sleeve and which, during its stroke, in one direction draws the fuel from the suction side into the working chamber of the pump and in the opposite direction first cuts off the connection to the suction side and then commences delivery of the fuel from the working chamber to the injection nozzle. A pump of this type is, for example, outlined in full detail in German Patent 34 16 355 or U.S. Pat. No. 4 617 894, and reference thereto is to be incorporated herein. In the present instance the working examples are only represented with the main elements of the pump, namely the pump piston 10 and piston sleeve 12.

In the delivery stroke, the piston 10 is driven from its bottom dead point in direction "F" by an eccentric cam on a drive shaft, while in the induction stroke a return spring moves the piston from its top dead point in the opposite direction of travel "S".

The piston sleeve 12 sits with its annular shoulder 12*s* immovably on a corresponding bearing surface of the pump housing (not shown) and is provided with two intake bores 12*a* and 12*aa*. In the suction stroke they allow the fuel to flow out from a suction chamber surrounding the piston sleeve and into the working chamber 12*b* formed over the outside end face 10*f* of the piston 10. The housing of a pressure valve (not shown) presses against the outside end face 12*f* of the piston sleeve 12, so that, in the delivery stroke of the piston 10, the fuel is delivered to the injection nozzle via this pressure valve. An internal annular space or groove 12*i* is also provided in the piston sleeve 12, and is delimited by a top and a bottom angular edge 12*io* and 12*iu* respectively.

On its periphery the piston 10 is provided with an inclined control groove 10*s* below the outer end face 10*f*. A groove 10*r* on the periphery of the piston 10 and parallel to the axis allows the working chamber 12*b* to communicate with the control groove 10*s*. The piston 10 can also turn about its axis, so that the control groove 10*s* can alter its position relative to the intake bore 12*aa*. This allows the duration of the main injection phase and hence the quantity of fuel delivered to be varied.

The piston 10 is further provided with a peripheral annular space or groove 10*u*, delimited in the axial direction by two peripheral annular edges 10*uo* and 10*uu*. An axial bore 10*g* and a cross bore 10*h* in the piston 10 connect the working chamber 12*b* to groove 10*u*. Moreover the piston 10 is provided with a further lateral overflow groove 10*x* which co-acts with the intake bore 12*a*, the top and bottom ends of said overflow groove being respectively designated by 10*xo* and 10*xu*.

The mutually parallel annular edges 12*io* and 12*iu* lie in planes perpendicular to the longitudinal axis of the piston 10 and are at a defined distance from one another. Peripheral annular edges 10*uo* and 10*uu* of the annular space 10*u* on the piston 10 likewise are parallel to one another and lie in planes perpendicular to the longitudinal axis of the piston 10. The bottom end 10*xu* of the groove 10*x* and the top peripheral annular edge 10*uo* are also positioned at a defined distance on the piston 10.

Figure 2:
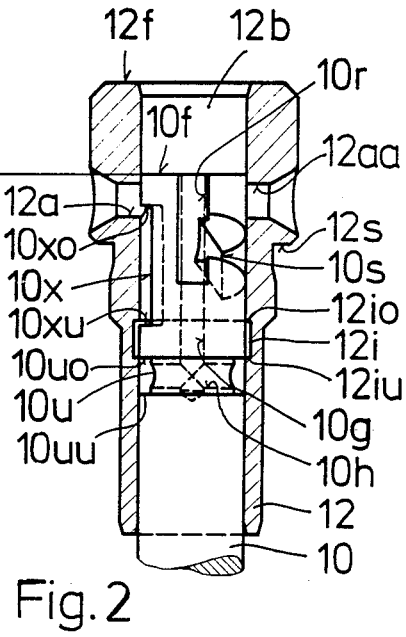

As soon as in the suction stroke the outside end face 10*f* of the piston 10 uncovers intake bores 12*a* and 12*aa* as it moves in direction "S", the fuel flows into the working chamber 12*b* until the piston reaches its bottom dead center. In the delivery stroke which follows in direction "F", the excess fuel will first overflow through the intake bores 12*a* and 12*aa* into the suction chamber enclosing the piston sleeve, until the outside end face 10*f* of the piston 10 slides over the two intake bores 12*a* and 12*aa* and closes them (FIG. 1). Delivery of the fuel from the closed working chamber 12*b* now begins along a short stroke path "V" of the piston 10. This delivery is brought to an abrupt end as soon as the peripheral annular edge 10*uo* slides over the annular edge 12*iu* of the piston sleeve 12 and enables the fuel to flow back out of the working chamber 12*b* to the suction side over the entire periphery of the piston (FIG. 2). This reflux is effected along path 10*g*, 10*h*, 10*u*, 12*i*, 12*a*. Delivery during the "V" stroke of the piston serves to pre-inject the fuel.

Figure 3:
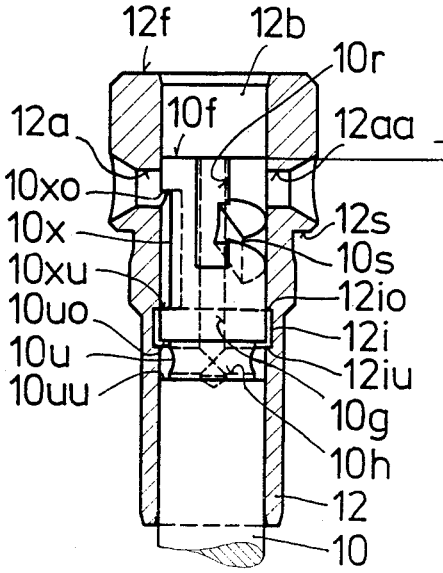

Once pre-injection is complete, in other words during a break in delivery, the fuel continues to spill until the end 10*xu* of the groove 10*x* on the piston 10 slides over annular edge 12*io* and cuts off the overflow path from the working chamber 12*b* to the suction side (FIG. 3).

As the piston continues its stroke a second delivery phase now begins, leading to the main injection of the fuel into the cylinder. Since the reflux process is interrupted abruptly at 10*xu*/12*io*, the main injection phase also at once commences in full.

Figure 4:
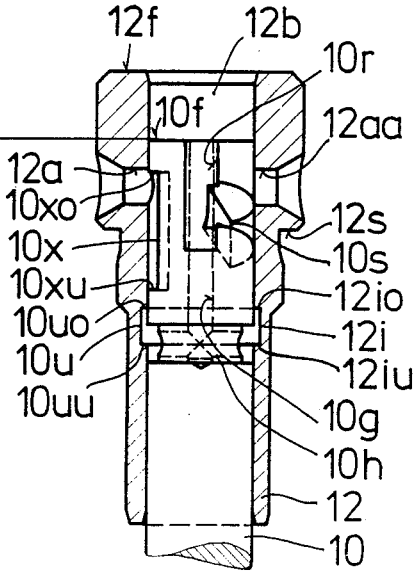

The main injection phase lasts until the top control edge of the inclined control groove 10*s* connects the working chamber 12*b* to the intake bore 12*aa* and releases the fuel to return to the suction side (FIG. 4). Since the relative position of the control groove 10*s* and the intake bore 12*aa* can be varied by angularly displacing the piston, the main injection quantity can be regulated at will.

Figure 5:
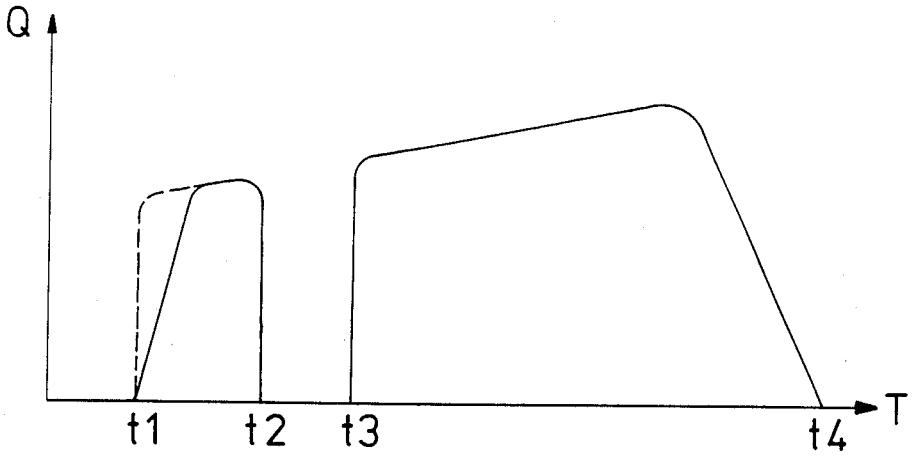
FIG. 5 is a graph of pump delivery.

The graph in FIG. 5 schematically represents the delivery quantities Q achieved during one stroke of the piston with respect to time T. Pre-injection starts at point t1 and lasts until it is abruptly ended at point t2. The main injection phase starts later at point t3 and lasts until point t4. Thus between points t2 and t3 there is a clear pause in delivery. During this pause, combustion of the pre-injection fuel intensely heats the air charge in the cylinder, so that the combustion of the main injected quantity which follows already starts at an elevated temperature, making the ignition lag (the interval between the start of the injection and fuel-self-ignition) extremely small. By this means during the entire combustion cycle a uniform, slow pressure rise in the cylinder is achieved, and with it a substantial reduction in combustion noise.

Figure 6:
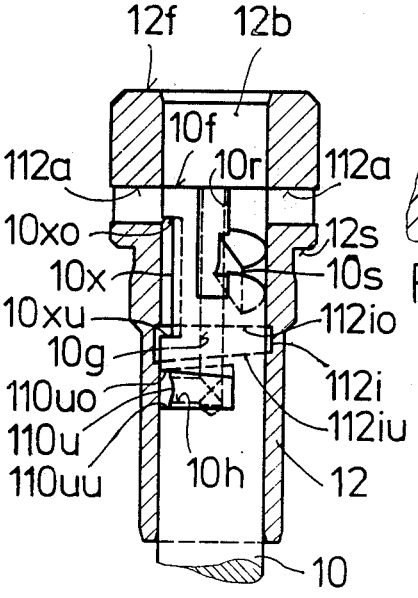
FIGS. 6 and 7 and FIG. 8 respectively are longitudinal sections of two further embodiments.
Figure 7:
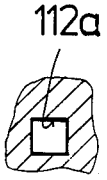

In the second embodiment, shown in FIGS. 6 and 7, two angular intake holes 112*a* are formed in the piston sleeve 12 in place of round intake bores. Thus the outside end face 10*f* of the piston suddenly closes the intake holes 112*a*, producing an abrupt start to pre-injection independent of the speed of the engine, as shown in the graph according to FIG. 5 by the steep start indicated by a dashed line at point tl.

Moreover, in the same embodiment the top outer edge 110*uo* of the external groove 110*u* of the piston and the bottom inner edge 112*iu* of the internal groove 112*i* of the piston sleeve are inclined at the same angle to the piston axis in the manner of a helix. During the turning of the piston, these edges assume different relative positions, so that the end of the pre-injection phase can be regulated in load-controlled manner during operation, i.e. in response to the respective main injection quantity set. This shifts point t2 along time co-ordinate T. In the embodiment of FIGS. 6 and 7 the external groove 11O*u* of the piston only extends about a portion of the piston periphery. The internal groove 112*i* of the piston sleeve 12 could be similarly delimited. In that case a leakage oil return, for example, could pass over the free peripheral area produced between the groove ends.

Figure 8:
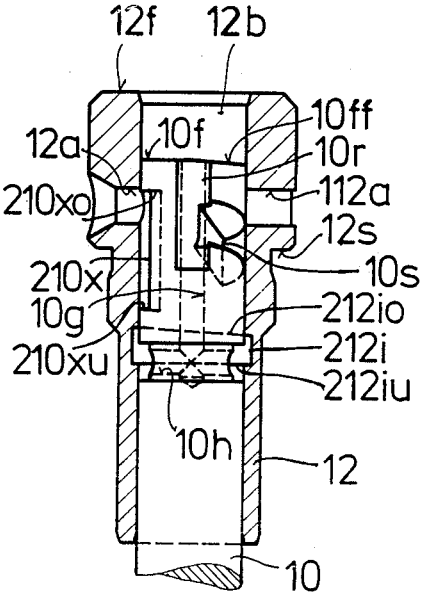

In the third embodiment of FIG. 8, the outside end face 10*f* of the piston which co-acts with the intake hole 112*a* is provided with a partial chamfer 10*ff*. This allows the outside end face 10*ff* and the intake opening 112*a* to be brought into different relative positions during turning of the piston, thereby varying the start of the pre-injection phase. This also enables load-controlled regulation of the pre-injected quantity.

In addition FIG. 8 shows that the bottom end 210*xu* of the overflow groove 210*x* on the piston 10, and the top inner edge 212*io* of the internal groove 212*i* on the piston sleeve 12, are arranged at a slight angle to the piston axis at the same angle of inclination. When the piston is turned the edges 210*xu* and 212*io* assume different relative positions, enabling the start of the main injection phase to be regulated in load-controlled manner.

In the constructional variants shown in FIGS. 6 to 8 the suction and delivery phases follow the same course as in FIGS. 1 to 4.

In addition to the variants shown in FIGS. 1 to 8, still further constructional variants are possible in which the features of the invention are realized in varying combinations.

The embodiments of the invention in which an exclusive property or privilege is claimed are defined as follows:

1. A fuel injection pump for internal combustion engines, comprising: a piston sleeve having means defining a bore therein at least one pump piston arranged movably in said bore of said piston sleeve, said piston having an end face, said piston end face being cooperable with said bore to a define a work chamber in said piston sleeve, means defining a suction chamber, injection means for drawing fuel from said suction chamber into said work chamber during a stroke of said piston in one direction and for, during a stroke of said piston in the other direction of travel, first isolating said work chamber from said suction chamber and then delivering fuel from said work chamber to an injection nozzle, means for opening a return path between said work chamber and said suction chamber, said opening means including a control groove formed on a peripheral surface of said piston and having a piston control edge which is inclined relative to a longitudinal axis of said piston, said injection means including control means operable during said stroke of said piston in said other direction for effecting a pre-injection of fuel into the injection nozzle and for thereafter effecting a main injection of fuel into the injection nozzle, said control means including cooperating grooves provided respectively in said piston and said piston sleeve, said piston groove and said piston sleeve groove being axially limited by parallel edges and being located across said inclined piston control edge from said work chamber so as to be separated from said work chamber, said piston having a connecting bore extending therethrough and connecting said work chamber to said piston groove, said piston having an axially extending overflow groove formed on said peripheral surface thereof, said piston sleeve groove being connectable to said suction chamber through said overflow groove.

2. The fuel injection pump according to claim 1, wherein said injection means further includes a suction bore and a return bore formed in said piston sleeve and connecting said suction chamber with said first-mentioned bore in said piston sleeve, said piston sleeve having an inner peripheral surface facing said first-mentioned bore, a portion of said piston sleeve inner peripheral surface which is located in said other direction relative to said suction and return bores and which surrounds said work chamber being a continuous, smooth, annular surface.

3. A fuel injection pump for an internal combustion engine, comprising: a piston sleeve having means defining an axially extending bore therein, at least one pump piston which is axially movably arranged in said bore of said piston sleeve, said piston having an outside end face, said piston end face being cooperable with said bore to define a working chamber in said piston sleeve, means defining a suction chamber, injection means operable during a stroke of said piston in one direction for drawing fuel from said suction chamber into said working chamber of the pump and for, during a stroke of said piston in the other said suction chamber and then delivering fuel from said working chamber to an injection nozzle, said injection means including control means operable during said piston stroke in said other direction for effecting a pre-injection of fuel into the injection nozzle and for thereafter effecting a main injection of fuel into the injection nozzle, said control means including said piston having a peripheral groove formed in an outer periphery thereof and axially limited by two axially spaced annular outer edges, said piston having a connecting bore formed therein, said peripheral groove communicating with said working chamber via said connecting bore in said piston, and one an inner surface of said piston sleeve there is provided an internal groove which is limited in the axial direction by two axially spaced annular inner edges, said piston having an axially extending overflow groove formed on said outer periphery thereof, said internal groove being communicatible with said suction chamber via said axially extending overflow groove on said piston, one of said outer edges of said peripheral groove on said piston being closest to said working chamber, one of said inner edges of said internal groove on said piston sleeve being remote from said working chamber, said one outer edge and said one inner edge being cooperable such that, when said working chamber is isolated from said suction chamber, movement of said piston in said other direction initiates the pre-injection of the fuel into the injection nozzle and, after a preset stroke path, said one outer edge of said peripheral groove in said piston slides past said one inner edge of said internal groove in said piston sleeve along its entire length and opens a fuel overflow path from said working chamber to said suction chamber via said peripheral groove in said piston, said internal groove in said piston sleeve and said overflow groove, thereby abruptly ending pre-injection, and movement of said piston through a further stroke path in said other direction closing the overflow path through said overflow groove in said piston and initiating the main injection.

4. The injection pump according to claim 3, in which said one outer edge of said peripheral groove of said piston, and said one inner edge of said internal groove of said piston sleeve which co-acts therewith, are inclined to said piston axis at the same angle.

5. The injection pump according to claim 4, in which said peripheral groove of said piston and said internal groove of said piston sleeve extend about the whole periphery of said piston and said piston sleeve, respectively.

6. The injection pump according to claim 4, in which at least one of said peripheral groove of said piston and said internal groove of said piston sleeve only extend about part of the periphery of said piston and said piston sleeve, respectively.

7. A fuel injection pump for an internal combustion engine, comprising: a piston sleeve having means defining an axially extending bore therein, at least one pump piston which is axially movably arranged in said bore of said piston sleeve, said piston having an outside end face, said piston end face being cooperable with said bore to define a working chamber in said piston sleeve, means defining a suction chamber, injection means operable during a stroke of said piston in one direction for drawing fuel from said suction chamber into said working chamber of the pump and for, during a stroke of said piston in the other direction of travel, first isolating said working chamber from said suction chamber and then delivering fuel from said working chamber to an injection nozzle, said injection means including control means operable during said piston stroke in said other direction for effecting a pre-injection of fuel into the injection nozzle and for thereafter effecting a main injection of fuel into the injection nozzle, said control means including said piston having a peripheral groove formed in an outer periphery thereof and axially limited by two axially spaced annular outer edge, said piston having a connecting bore formed therein, said peripheral groove communicating with said working chamber via said connecting bore in said piston, and on an inner surface of said piston sleeve there is provided an internal groove which is limited in the axial direction by two axially spaced annular inner edges, said piston having an axially extending overflow groove formed on said outer periphery thereof, said internal groove being communicatible with said suction chamber via said axially extending overflow groove on said piston, one of said outer edges of said peripheral groove on said piston being closest to said working chamber, one of said inner edges of said internal groove on said piston sleeve being remote from said working chamber, said one outer edge and said one inner edge being parallel such that, when said working chamber is isolated from said suction chamber, movement of said piston in said other direction initiates the pre-injection of the fuel into the injection nozzle and, after a preset stroke path, said one outer edge of said peripheral groove in said piston slides past said one inner edge of said internal groove in said piston sleeve along its entire length and opens a fuel overflow path from said working chamber to said suction chamber via said peripheral groove in said piston, said internal groove in said piston sleeve and said overflow groove, thereby abruptly ending pre-injection, and movement of said piston through a further stroke path in said other direction closing the overflow path through said overflow groove in said piston and initiating the main injection.

8. An injection pump according to claim 7, in which said peripheral groove of said piston and said internal groove of said piston sleeve extend about the whole periphery of said piston and said piston sleeve, respectively.

9. An injection pump according to claim 7, in which at least one of said peripheral groove of said piston and said internal groove of said piston sleeve only extend about part of the periphery of said piston and said piston sleeve, respectively.

10. An injection pump according to claim 7, in which said one outer edge of said peripheral groove of said piston, and said one inner edge of said internal groove of said piston sleeve which co-acts therewith, are perpendicular to said piston axis.

11. An injection pump according to claim 10, in which said peripheral groove of said piston and said internal groove of said piston sleeve extend about the whole periphery of said piston and said piston sleeve, respectively.

12. An injection pump according to claim 10, in which at least one said peripheral groove of said piston and said internal groove of said piston sleeve only extend about part of the periphery of said piston and said piston sleeve, respectively.

13. An injection pump according to claim 7, in which said one outer edge of said peripheral groove of said piston, and said one inner edge of said internal groove of said piston sleeve which co-acts therewith, are inclined to said piston axis at the same angle.

14. An injection pump according to claim 13, in which said peripheral groove of said piston and said internal groove of said piston sleeve extend about the whole periphery of said piston and said piston sleeve, respectively.

15. An injection pump according to claim 13, in which at least one of said peripheral groove of said piston and said internal groove of said piston sleeve only extend about part of the periphery of said piston and said piston sleeve, respectively.

16. An injection pump according to claim 6, in which said outside end face of said piston that delimits said working chamber is perpendicular to the axis thereof.

17. An injection pump according to claim 6, in which said outside end face of said piston that delimits said working chamber is at least in part inclined to the axis thereof.

18. An injection pump according to claim 7, in which said injection means further includes at least one suction port connecting said suction chamber and said working chamber and provided in said piston sleeve, a limiting edge of said suction port lying furthest in said other direction being parallel to said outside end face of said piston.

19. An injection pump according to claim 6, in which an end of said axial overflow groove adjoining said peripheral groove of said piston is constituted by an end face which is perpendicular to said piston axis.

20. An injection pump according to claim 7, in which an end of said axially extending overflow groove adjoining said peripheral groove in said piston is constituted by an end face which is inclined to said piston axis, wherein the other of said inner edges of said internal groove in said piston sleeve co-acts with said end face to close said overflow path through said overflow groove, and wherein said other inner edge is inclined to said piston axis at the same angle as said end face.

* * * * *

UNITED STATES PATENT AND TRADEMARK OFFICE

CERTIFICATE OF CORRECTION

PATENT NO. : 4 897 024

DATED : January 30, 1990

INVENTOR(S) : Ernst HATZ et al.

It is certified that error appears in the above-identified patent and that said Letters Patent is hereby corrected as shown below:

Column 5, line 53; after "therein" insert ---,---.

Column 6, line 40; after "other" insert
---direction of travel, first isolating said working chamber from---.

Column 7, line 48; change "edge," to ---edges,---.

Column 8, line 51; change "claim 6," to ---claim 7,---.
line 53; change "the" to ---said---.
line 54; change "claim 6," to ---claim 7,---.
line 56; change "the" to ---said---.
line 65; change "claim 6," to ---claim 7,---.

Signed and Sealed this

First Day of October, 1991

*Attest:*

HARRY F. MANBECK, JR.

*Attesting Officer*

*Commissioner of Patents and Trademarks*